US008570229B2

(12) United States Patent
Yoon et al.

(10) Patent No.: US 8,570,229 B2
(45) Date of Patent: Oct. 29, 2013

(54) MULTIPLE ANTENNA HIGH ISOLATION APPARATUS AND APPLICATION THEREOF

(75) Inventors: Seunghwan Yoon, Costa Mesa, CA (US); Nicolaos G. Alexopoulos, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 684 days.

(21) Appl. No.: 12/772,129

(22) Filed: Apr. 30, 2010

(65) Prior Publication Data

US 2010/0220022 A1 Sep. 2, 2010

Related U.S. Application Data

(63) Continuation-in-part of application No. 12/642,360, filed on Dec. 18, 2009.

(60) Provisional application No. 61/145,049, filed on Jan. 15, 2009, provisional application No. 61/253,958, filed on Oct. 22, 2009.

(51) Int. Cl.

| | |
|---|---|
| ***H01Q 1/38*** | (2006.01) |
| ***H01Q 1/24*** | (2006.01) |
| ***H01Q 21/24*** | (2006.01) |

(52) U.S. Cl.

USPC ..... 343/727; 343/795; 343/893

(58) Field of Classification Search

USPC ..... 343/725, 727, 729, 730, 795, 846, 853, 343/893

See application file for complete search history.

(56) References Cited

U.S. PATENT DOCUMENTS

| | | | | |
|---|---|---|---|---|
| 2,982,959 | A * | 5/1961 | Hanneken | 343/724 |
| 4,486,758 | A * | 12/1984 | de Ronde | 343/700 MS |
| 5,300,936 | A * | 4/1994 | Izadian | 343/700 MS |
| 5,801,660 | A | 9/1998 | Ohtsuka et al. | |
| 6,104,349 | A * | 8/2000 | Cohen | 343/702 |
| 7,015,868 | B2 * | 3/2006 | Puente Baliarde et al. | 343/800 |
| 7,561,112 | B2 * | 7/2009 | Sako | 343/727 |
| 7,711,337 | B2 * | 5/2010 | Mckinzie et al. | 455/248.1 |
| 2003/0222821 | A1 | 12/2003 | Mikkonen | |
| 2004/0160368 | A1 | 8/2004 | Huang | |
| 2006/0256018 | A1 | 11/2006 | Soler Castany et al. | |
| 2010/0177001 | A1 | 7/2010 | Alexopolous | |

FOREIGN PATENT DOCUMENTS

| | | | | |
|---|---|---|---|---|
| WO | 2004095635 | A1 | 11/2004 | |
| WO | WO2008/081200 | A1 * | 7/2008 | H01Q 21/26 |

OTHER PUBLICATIONS

European Search Report; Application No. 10015737.9-2220; Apr. 8, 2011; 4 pages.

Crnojevic-Bengin V.; "Compact 2D Hilbert Microstrip Resonators"; Microwave and Optical Technology Letters; vol. 48, No. 2; Feb. 2006; pp. 270-273.

* cited by examiner

*Primary Examiner* — Michael C Wimer

(74) *Attorney, Agent, or Firm* — Garlick & Markison; Randy W. Lacasse

(57) ABSTRACT

A multiple antenna apparatus includes a substrate, a first antenna structure, and a second antenna structure. The first antenna structure includes a first metal trace that has a first pattern confined in a first geometric shape and has a near-zero electric field plane. The second antenna structure includes a second metal trace that has a first pattern confined to a second geometric shape. The second antenna structure is positioned on the substrate in substantial alignment with the near-zero electric field plane of the first antenna structure.

21 Claims, 11 Drawing Sheets

MULTIPLE ANTENNA HIGH ISOLATION APPARATUS AND APPLICATION THEREOF

CROSS REFERENCE TO RELATED PATENTS

This patent application is claiming priority under 35 USC §120 as a continuation in part patent application of co-pending patent application entitled ANTENNA STRUCTURES AND APPLICATIONS THEREOF, having a filing date of Dec. 18, 2009, and a Ser. No. 12/642,360, which claims priority to a provisional patent application entitled ANTENNA STRUCTURE AND OPERATIONS, having a provisional filing date of Jan. 15, 2009, and a provisional Ser. No. 61/145,049.

This patent application is also claiming priority under 35 USC §119 to a provisionally filed patent application entitled MULTIPLE ANTENNA APPARATUS AND APPLICATION THEREOF, having a filing date of Oct. 22, 2009, and a Ser. No. 61/253,958.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to wireless communication systems and more particularly to wireless communication devices and/or components thereof.

2. Description of Related Art

Communication systems are known to support wireless and wire lined communications between wireless and/or wire lined communication devices. Such communication systems range from national and/or international cellular telephone systems to the Internet to point-to-point in-home wireless networks. Each type of communication system is constructed, and hence operates, in accordance with one or more communication standards. For instance, wireless communication systems may operate in accordance with one or more standards including, but not limited to, IEEE 802.11, Bluetooth, advanced mobile phone services (AMPS), digital AMPS, global system for mobile communications (GSM), code division multiple access (CDMA), local multi-point distribution systems (LMDS), multi-channel-multi-point distribution systems (MMDS), radio frequency identification (RFID), Enhanced Data rates for GSM Evolution (EDGE), General Packet Radio Service (GPRS), WCDMA, LTE (Long Term Evolution), WiMAX (worldwide interoperability for microwave access), and/or variations thereof.

Depending on the type of wireless communication system, a wireless communication device, such as a cellular telephone, two-way radio, personal digital assistant (PDA), personal computer (PC), laptop computer, home entertainment equipment, RFID reader, RFID tag, et cetera communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via the public switch telephone network, via the Internet, and/or via some other wide area network.

For each wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the receiver is coupled to the antenna and includes a low noise amplifier, one or more intermediate frequency stages, a filtering stage, and a data recovery stage. The low noise amplifier receives inbound RF signals via the antenna and amplifies then. The one or more intermediate frequency stages mix the amplified RF signals with one or more local oscillations to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

As is also known, the transmitter includes a data modulation stage, one or more intermediate frequency stages, and a power amplifier. The data modulation stage converts raw data into baseband signals in accordance with a particular wireless communication standard. The one or more intermediate frequency stages mix the baseband signals with one or more local oscillations to produce RF signals. The power amplifier amplifies the RF signals prior to transmission via an antenna.

Currently, wireless communications occur within licensed or unlicensed frequency spectrums. For example, wireless local area network (WLAN) communications occur within the unlicensed Industrial, Scientific, and Medical (ISM) frequency spectrum of 900 MHz, 2.4 GHz, and 5 GHz. While the ISM frequency spectrum is unlicensed there are restrictions on power, modulation techniques, and antenna gain. Another unlicensed frequency spectrum is the V-band of 55-64 GHz.

Since the wireless part of a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, the same polarization, different polarization, and/or any number of other electro-magnetic properties.

One popular antenna structure for RF transceivers is a three-dimensional in-air helix antenna, which resembles an expanded spring. The in-air helix antenna provides a magnetic omni-directional monopole antenna. Other types of three-dimensional antennas include aperture antennas of a rectangular shape, horn shaped, etc, three-dimensional dipole antennas having a conical shape, a cylinder shape, an elliptical shape, etc.; and reflector antennas having a plane reflector, a corner reflector, or a parabolic reflector. An issue with such three-dimensional antennas is that they cannot be implemented in the substantially two-dimensional space of an integrated circuit (IC) and/or on the printed circuit board (PCB) supporting the IC.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/($900\times10^6$ c/s)= 0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/($2.4\times10^9$ c/s)=0.25*12.5 cm). As such, due to the antenna size, it cannot be implemented on-chip since a relatively complex IC having millions of transistors has a size of 2 to 20 millimeters by 2 to 20 millimeters.

While two-dimensional antennas provide reasonably antenna performance for many wireless communication devices, there are issues when the wireless communication devices require full duplex operation and/or multiple input and/or multiple output (e.g., single input multiple output, multiple input multiple output, multiple input single output) operation. For instance, in a full duplex wireless communication, the wireless communication device simultaneously transmits and receives signals. For full duplex wireless communications to work reasonably well, the receiver antenna(s) must be isolated from the transmitter antenna(s) (e.g., >20 dBm). One popular mechanism is to use an isolator. Another popular mechanism is to use duplexers. While such mechanisms provide receiver antenna(s) isolation from the transmitter antenna(s), but does so at the cost of increasing the overall manufacturing costs of wireless communication devices.

Therefore, a need exists for a more efficient antenna apparatus and applications thereof.

BRIEF SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

BRIEF DESCRIPTION OF THE SEVERAL VIEWS OF THE DRAWING(S)

Figures 8A, 8B, 8C:
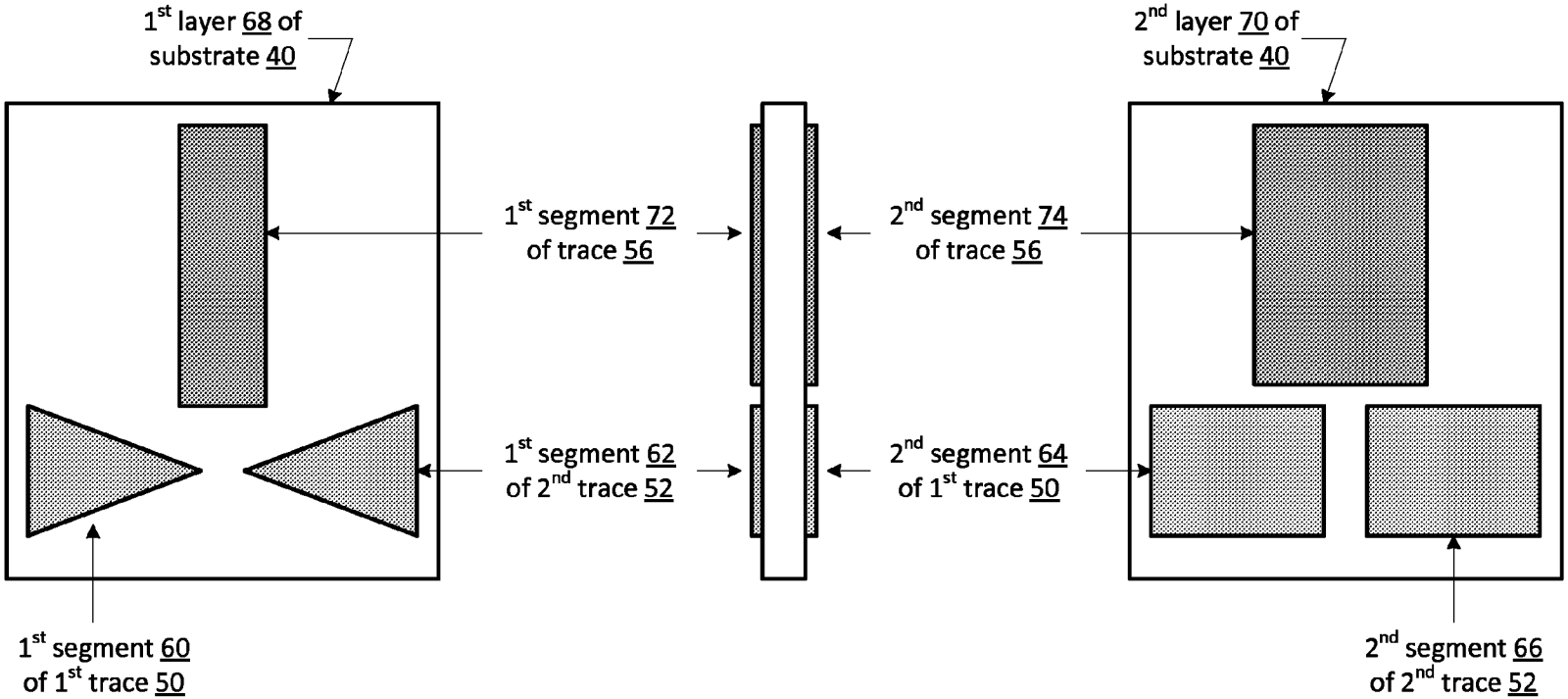
Figures 9A, 9B, 9C:
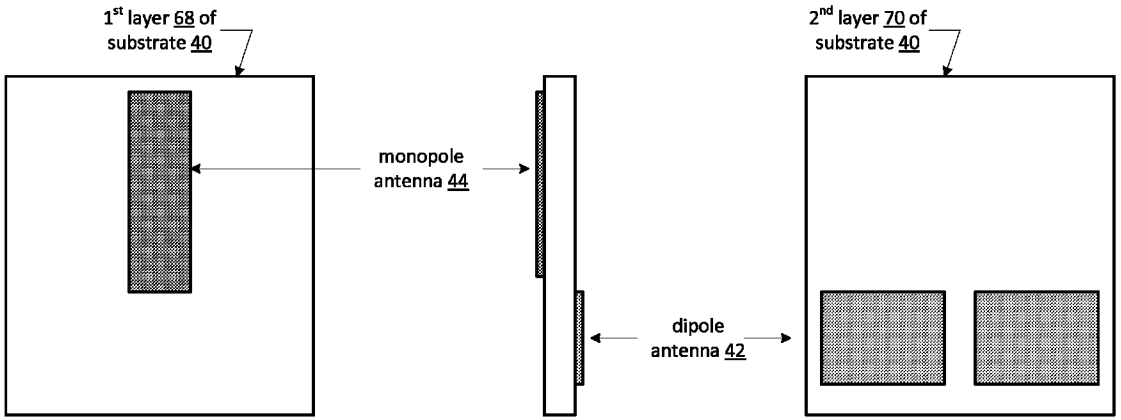
Figure 10:
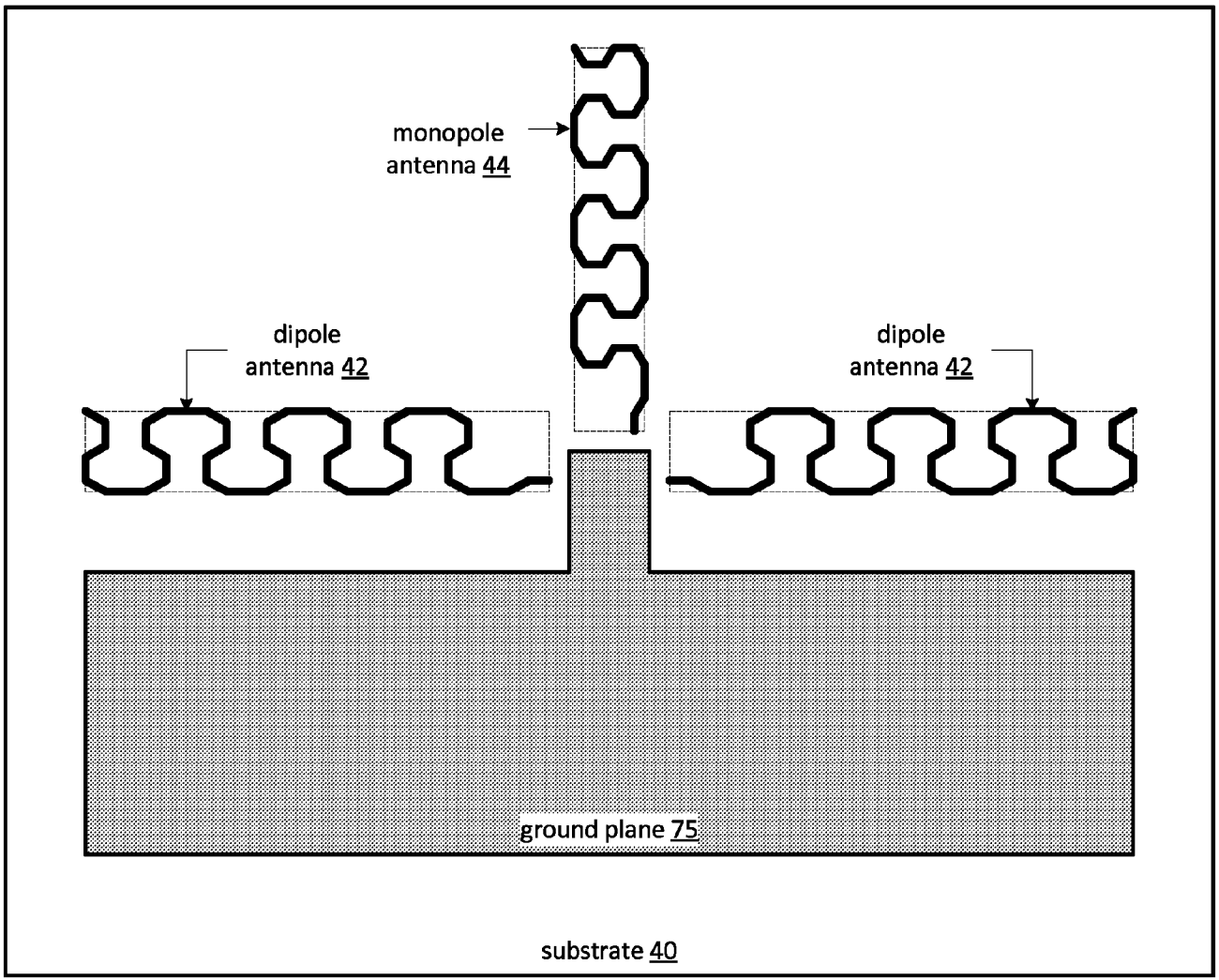
Figure 11:
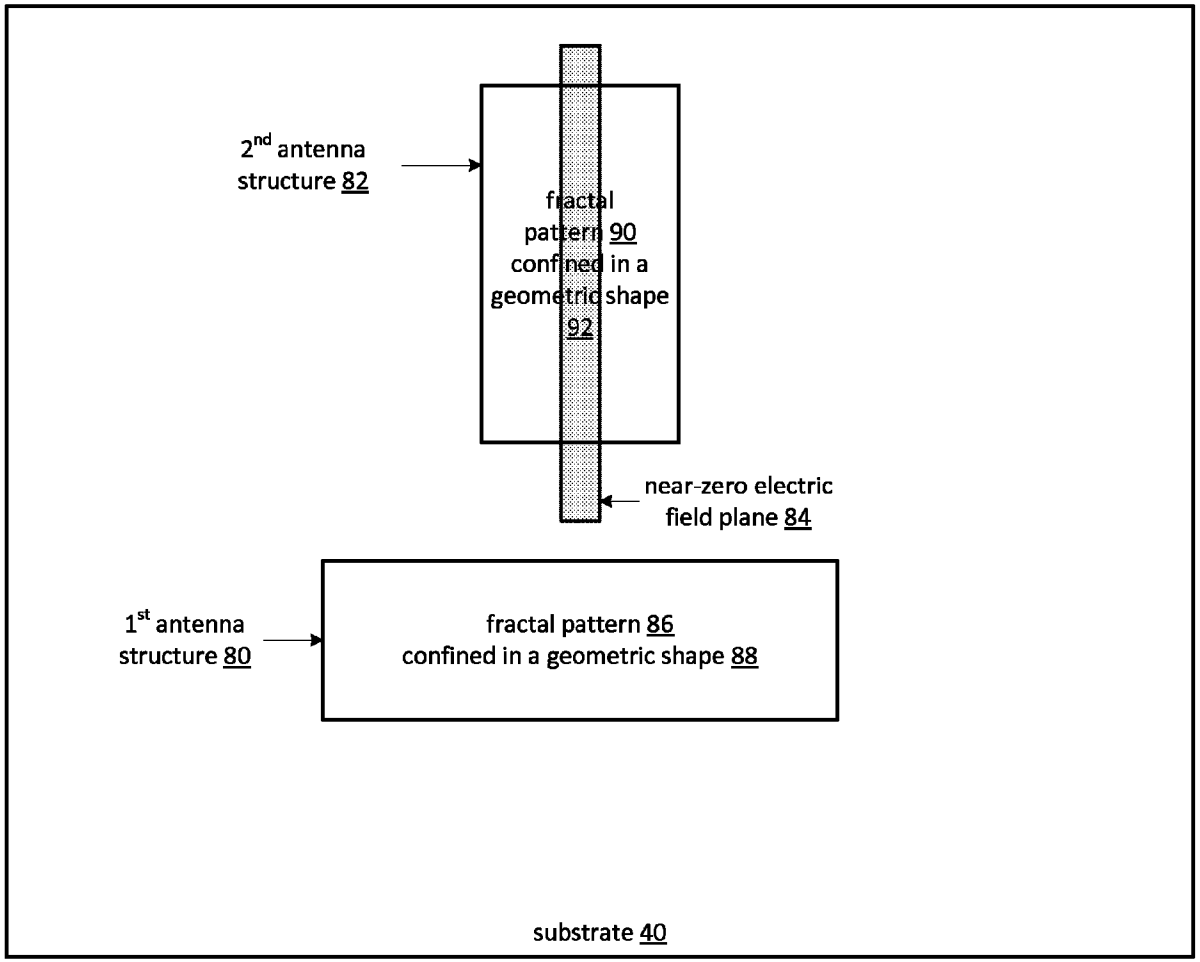
Figure 12:
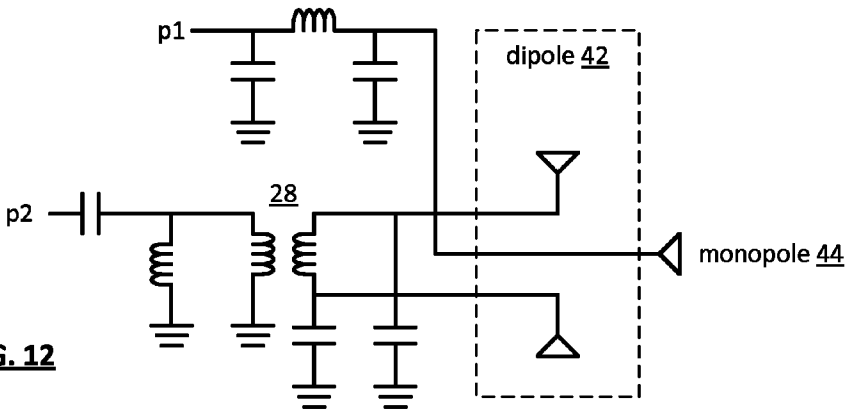
Figure 13A:
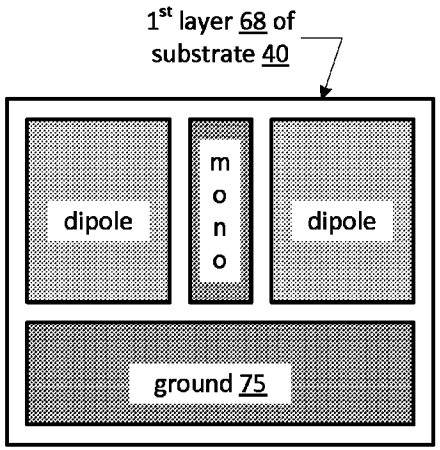
Figure 13B:
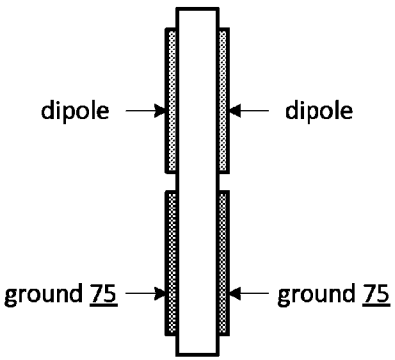
Figure 13C:
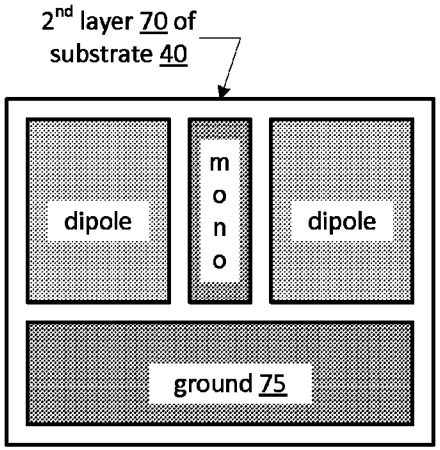

FIGS. 8A-C are diagrams of another embodiment of a multiple antenna apparatus in accordance with the present invention;

FIGS. 9A-C are diagrams of another embodiment of a multiple antenna apparatus in accordance with the present invention;

FIG. 10 is a diagram of another embodiment of a multiple antenna apparatus in accordance with the present invention;

FIG. 11 is a diagram of another embodiment of a multiple antenna apparatus in accordance with the present invention;

FIG. 12 is a schematic diagram of another embodiment of a multiple antenna apparatus in accordance with the present invention; and FIGS. 13A-C are diagrams of another embodiment of a multiple antenna apparatus in accordance with the present invention.

DETAILED DESCRIPTION OF THE INVENTION

Figure 1:
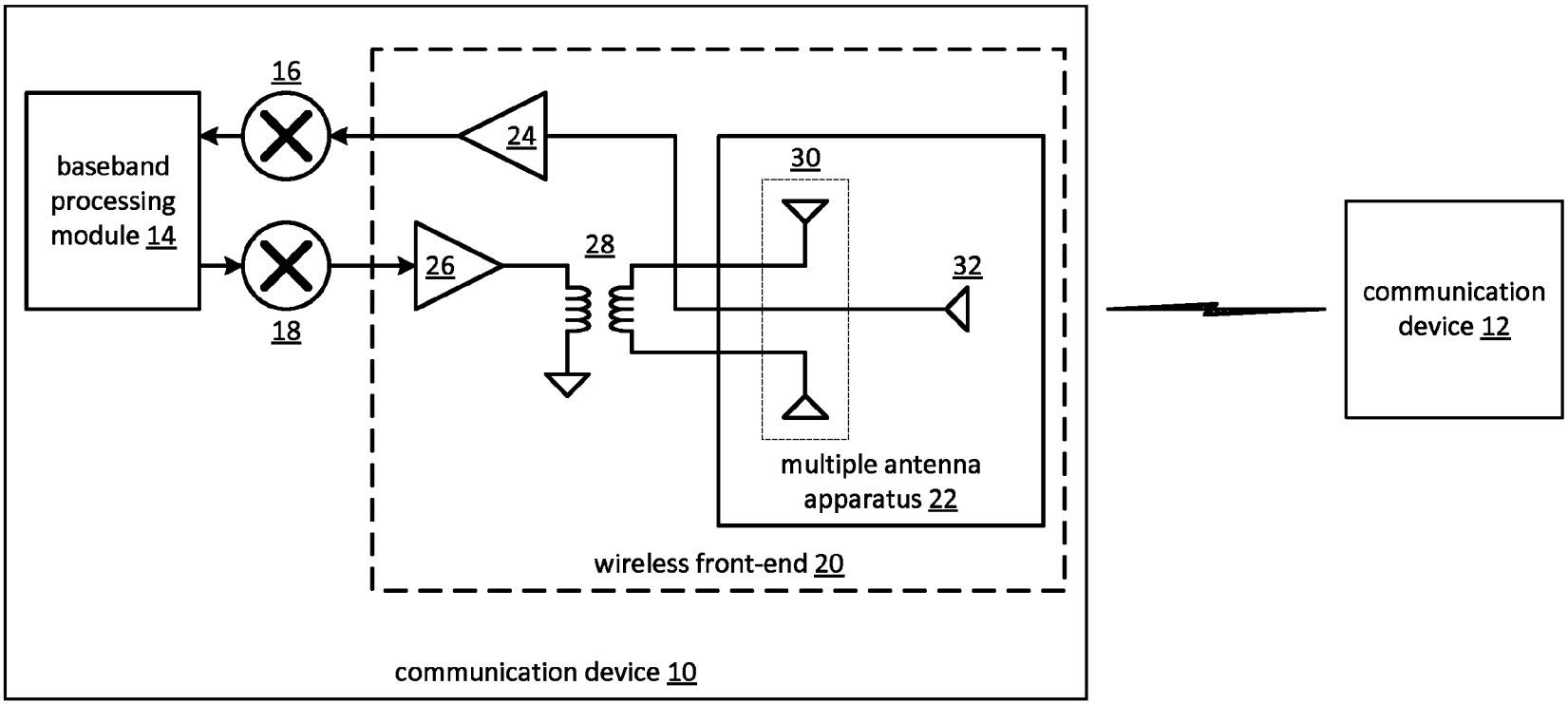
FIG. 1 is a schematic block diagram of an embodiment of wireless communication devices in accordance with the present invention.

FIG. 1 is a schematic block diagram of an embodiment of wireless communication devices 10-12. Each communication device 10-12 may be a cellular telephone, a personal computer, a laptop computer, a video game unit, a personal digital entertainment unit (e.g., MP3 player, personal video player, etc), a wireless local area network (WLAN) station, a WLAN access point, a wireless headset, a wireless computer peripheral device (e.g., mouse, keyboard, etc.), a digital camera, etc. To support a wireless communication, the communication devices 10-12 include a baseband processing module 14, a down conversion mixing module 16, an up conversion mixing module 18, and a wireless front-end 20. The wireless front-end 20 includes a first amplifier 26, a second amplifier 24, a transformer balun 28, and a multiple antenna apparatus 22. The multiple antenna apparatus 22 includes a first antenna structure 30 and a second antenna structure 32.

The baseband processing module 14 may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module may have an associated memory and/or memory element, which may be a single memory device, a plurality of memory devices, and/or embedded circuitry of the processing module. Such a memory device may be a read-only memory, random access memory, volatile memory, non-volatile memory, static memory, dynamic memory, flash memory, cache memory, and/or any device that stores digital information. Note that if the processing module includes more than one processing device, the processing devices may be centrally located (e.g., directly coupled together via a wired and/or wireless bus structure) or may be distributedly located (e.g., cloud computing via indirect coupling via a local area network and/or a wide area network). Further note that when the processing module implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element stores, and the processing module executes, hard coded and/or operational instructions corresponding to at least some of the steps and/or functions illustrated in FIGS. 1-11.

In an example of operation, the baseband processing module 14 receives outbound data (e.g., voice, text, audio, video, graphics, etc.) for other circuitry within the communication unit 10-12 or from an externally coupled device. The baseband processing module 14 converts the outbound data into outbound symbol stream in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion includes one or more of: scrambling, puncturing, encoding, interleaving, constellation mapping, modulation, frequency spreading, frequency hopping, beamforming, space-time-block encoding, space-frequency-block encoding, frequency to time domain conversion, and/or digital baseband to intermediate frequency conversion.

The up conversion mixing module 18 (which includes one or more mixers, one or more one or more bandpass filters, etc.) mixes the outbound symbol stream with a transmit local oscillation to produce an up-converted signal. This may be done in a variety of ways. For example, in-phase and quadrature components of the outbound symbol stream are mixed with in-phase and quadrature components of the transmit local oscillation to produce the up-converted signal. In another example, the outbound symbol stream provides phase information (e.g., $+/-\Delta\theta$ [phase shift] and/or $\theta(t)$ [phase modulation]) that adjusts the phase of the transmit local oscillation to produce a phase adjusted up-converted signal. In this example, the phase adjusted up-converted signal provides the up-converted signal. In furtherance of this example, the outbound symbol stream further includes amplitude information (e.g., A(t) [amplitude modulation]), which is used to adjust the amplitude of the phase adjusted up converted signal to produce the up-converted signal. In yet another example, the outbound provides frequency information (e.g., $+/-\Delta f$ [frequency shift] and/or f(t) [frequency modulation]) that adjusts the frequency of the transmit local oscillation to produce a frequency adjusted up-converted signal. In this example, the frequency adjusted up-converted signal provides the up-converted signal. In furtherance of this example, the outbound symbol stream further includes amplitude information, which is used to adjust the amplitude of the frequency adjusted up-converted signal to produce the up-converted signal. In a further example, the outbound symbol stream provides amplitude information (e.g., $+/-\Delta A$ [amplitude shift] and/or A(t) [amplitude modulation) that adjusts the amplitude of the transmit local oscillation to produce the up-converted signal.

The first amplifier 26 (which includes one or more power amplifier drivers and/or power amplifiers) amplifies the up-converted signal to produce an outbound radio frequency (RF) or millimeter wave (MMW) signal. Note that an RF signal may have a carrier frequency up to approximately 3 GHz and a MMW signal may have a carrier frequency in the range of 3 GHz to 300 GHz.

The transformer balun 28 generates an inverted and non-inverted representation of the outbound RF or MMW signal, which it provides to the first antenna 30. The first antenna structure 30 may be implemented on a substrate (e.g., a printed circuit board, an integrated circuit, etc.) that includes one or more antennas (e.g., single antenna, diversity antenna structure, antenna array, etc.) having one or more antenna models (e.g., monopole, dipole, random wire, etc.). For example, the first antenna 30 may be one or more a dipole antenna, which transmits the outbound RF or MMW signal. Regardless of the specific implementation of the first antenna structure 30, it produces a near zero electric field (e.g., a plane tangential to the electric field).

For full duplex wireless communication, as the communication device 10 transmits the outbound RF or MMW signal it may also be receiving an inbound RF or MMW signal via the second antenna 32 of the multiple antenna apparatus 22. The second antenna 32 may be a planar antenna structure implemented on a substrate (e.g., a printed circuit board, an integrated circuit, etc.) that includes one or more antennas (e.g., single antenna, diversity antenna structure, antenna array, etc.) having one or more antenna models (e.g., monopole, dipole, random wire, etc.) For example, the second antenna 32 may be a monopole antenna.

To provide isolation between the transmitting antenna (e.g., antenna 30) and the receiving antenna (e.g., antenna 32), the antennas are positioned on the substrate such that at least one of them is physically located within a zero electric field plane of the other antenna, which may also be referred to as a symmetry plane or an electric wall. For example, the first antenna 30 has a zero electric field plane (e.g., a near zero electromagnet radiation plane) substantially perpendicular to its two antenna elements. By positioning the second antenna 32 within the zero electric field plane, it receives little electromagnetic energy from the first antenna 30 such that a desire level of isolation is achieved (e.g., >20 dB). Various embodiments of the multiple antenna apparatus 22 will be described in greater detail with reference to FIGS. 4-11.

The second antenna 32 provides the inbound RF or MMW signal to the second amplifier 24, which may include one or more low noise amplifiers. The second amplifier 24 amplifies the inbound RF or MMW signal to produce an amplified inbound RF or MMW signal, which it provides to the down conversion mixing module 16.

The down conversion mixing module 16 (which includes one or more mixers, one or more low pass and/or bandpass filters, etc.) mixes in-phase (I) and quadrature (Q) components of the amplified inbound RF or MMW signal with in-phase and quadrature components of a local oscillation to produce a mixed I signal and a mixed Q signal. The mixed I and Q signals are combined to produce an inbound symbol stream. In this example, the inbound symbol may include phase information (e.g., $+/-\Delta\theta$ [phase shift] and/or $\theta(t)$ [phase modulation]) and/or frequency information (e.g., $+/-\Delta f$ [frequency shift] and/or f(t) [frequency modulation]). In another example and/or in furtherance of the preceding example, the inbound RF or MMW signal includes amplitude information (e.g., $+/-\Delta A$ [amplitude shift] and/or A(t) [amplitude modulation]). To recover the amplitude information, the down conversion mixing module 16 includes an amplitude detector such as an envelope detector, a low pass filter, etc.

The baseband processing module 16 converts the inbound symbol stream into inbound data (e.g., voice, text, audio, video, graphics, etc.) in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion may include one or more of: digital intermediate frequency to baseband conversion, time to frequency domain conversion, space-time-block decoding, space-frequency-block decoding, demodulation, frequency spread decoding, frequency hopping decoding, beamforming decoding, constellation demapping, deinterleaving, decoding, depuncturing, and/or descrambling.

Figure 2:
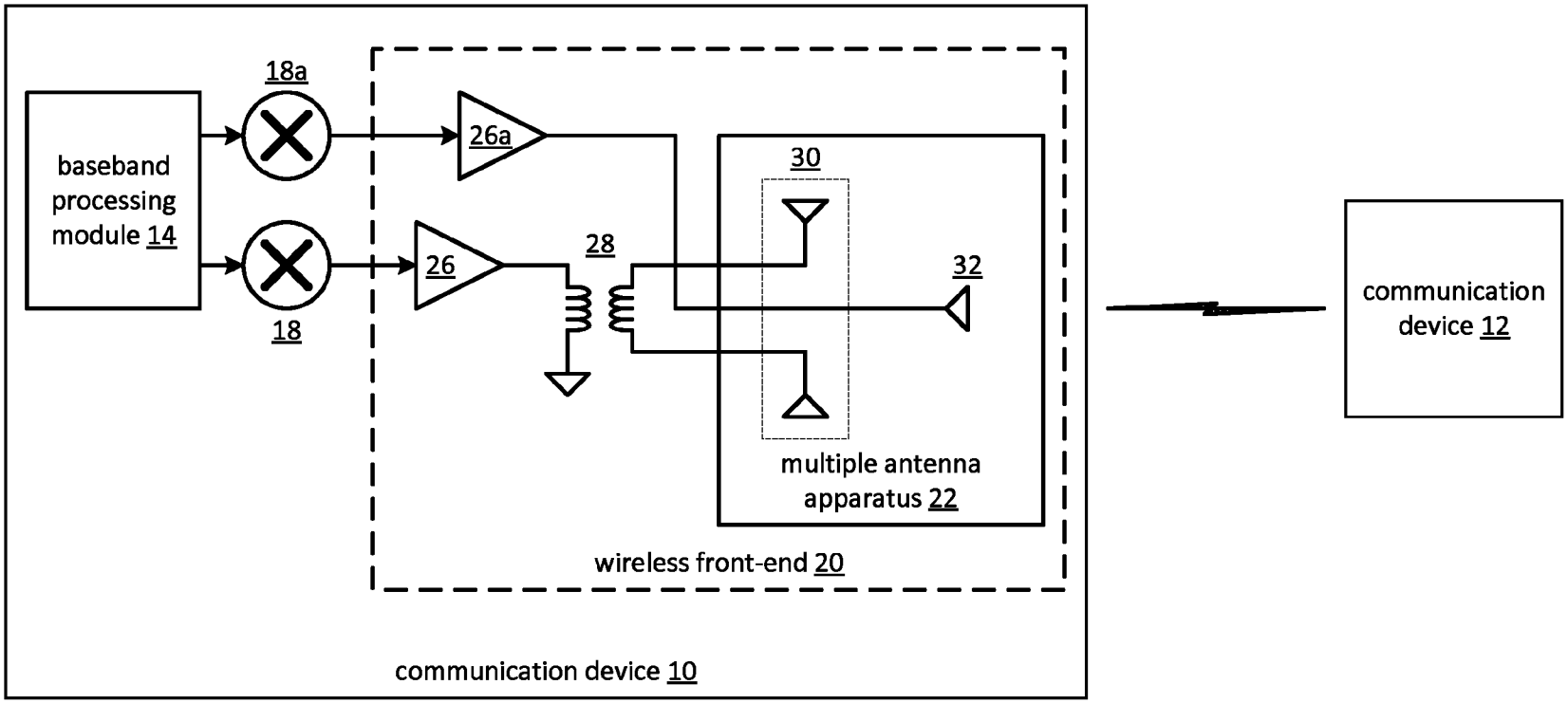
FIG. 2 is a schematic block diagram of another embodiment of wireless communication devices in accordance with the present invention.

FIG. 2 is a schematic block diagram of another embodiment of wireless communication devices 10-12 wirelessly communicating. The communication devices 10-12 include the baseband processing module 14, two or more up conversion mixing modules 18-18*a*, and the wireless front-end 20. In this embodiment, the wireless front-end 20 includes two or more power amplifiers and/or power amplifier drivers 26-26*a*, one or more transformer baluns 28, and the multiple antenna apparatus 22.

In an example of operation, the baseband processing module 16 receives outbound data and converts into a plurality of outbound symbol streams in accordance with a multiple input multiple output (MIMO) or single input multiple output (SIMO) communication protocol (e.g., IEEE 802.11n, WiMAX, 4G cellular, etc.). A first one of the outbound symbol streams is up converted by a first one of the up conversion mixing modules 18-18*a* to produce a first up converted signal. The other up conversion mixing modules 18-18*a* up converts the other outbound symbol streams to produce other up converted signals.

The power amplifiers 26-26*a* amplifies the plurality of up converted signals to produce a plurality of outbound RF or MMW signals (e.g., transmission signals of a MIMO or SIMO signal). The transformer balun 28 generates an inverting and non-inverting representation of one of the outbound RF or MMW signals, which are provided to the first antenna 20. The second antenna 32 receives the outbound RF or MMW signal from power amplifier 26*a*. In this embodiment, the second antenna 32 is isolated (e.g., >20 dB of isolation) from the first antenna 30 as discussed with reference to FIG. 1 such that the outbound RF or MMW signals are transmitted with reduced interference therebetween.

Figure 3:
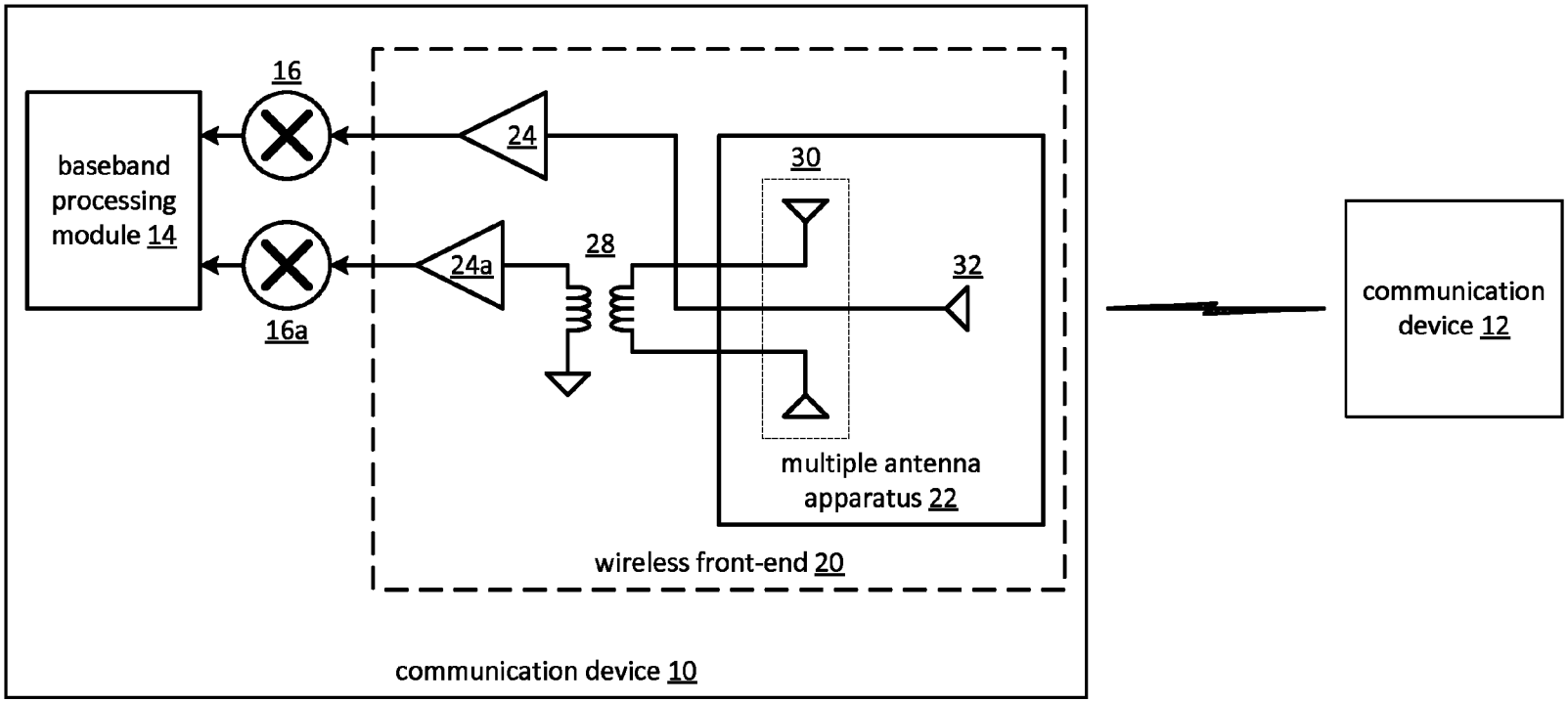
FIG. 3 is a schematic block diagram of another embodiment of wireless communication devices in accordance with the present invention.

FIG. 3 is a schematic block diagram of another embodiment of wireless communication devices 10-12 wirelessly communicating. The communication devices 10-12 include the baseband processing module 14, two or more down conversion mixing modules 16-1*a*, and the wireless front-end 20. In this embodiment, the wireless front-end 20 includes two or more low noise amplifiers 24-24*a*, one or more transformer baluns 28, and the multiple antenna apparatus 22.

In an example of operation, the multiple antenna apparatus 22 receives a multiple input multiple output (MIMO) signal or a multiple input single output (MISO) signal, which is in accordance with a wireless communication protocol (e.g., IEEE 802.11n, WiMAX, 4G cellular, etc.). For instance, the first antenna receives a first reception signal of the MIMO or MISO signal and the second antenna 32 receives a second reception signal of the MIMO or MISO signal.

The transformer balun 28 provides the first reception signal to a first one of the amplifiers 24-24*a*, which amplifies the signal to produce a first amplified reception signal. The other amplifier 24-24*a* receives the second reception signal of the MIMO of MISO signal from the second antenna and amplifies it to produce a second amplified reception signal.

The down conversion mixing modules 16-16*a* convert the plurality of amplified reception signals into a plurality of inbound symbol streams. The baseband processing module 14 processes the plurality of inbound symbol streams to produce inbound data.

Figure 4:
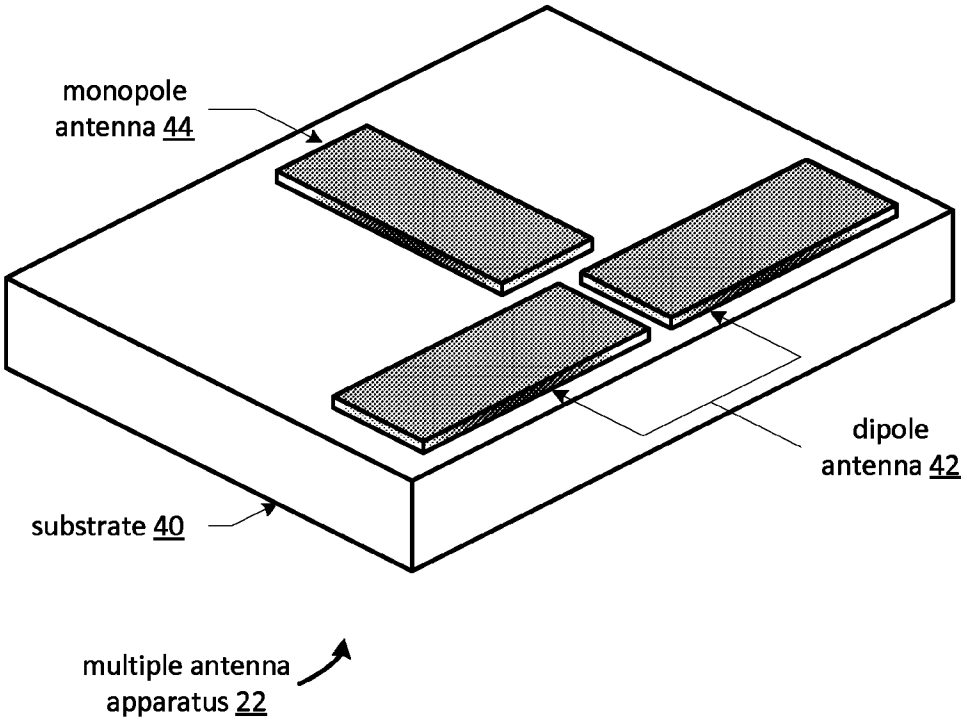
FIG. 4 is a block diagram of an embodiment of a multiple antenna apparatus in accordance with the present invention.

FIG. 4 is a block diagram of an embodiment of a multiple antenna apparatus 22 that includes a substrate 40 (e.g., PCB, IC, etc.), a dipole antenna 42 as the first antenna 30, and a monopole antenna 44 as the second antenna 32. The dipole antenna 42 has a near-zero electric field plane in which the monopole antenna 44 is positioned. In this regard, the monopole antenna 44 is isolated (e.g., >20 dB) from the dipole antenna 42.

The particular construct of the dipole antenna 42 and the monopole antenna 44 is dependent on the desired performance requirements of the antennas 42 and 44. The performance requirements include one or more of frequency band, bandwidth, gain, impedance, efficiency, and polarization. For example, if the both antennas 42 and 44 are for 60 GHz, communications, the monopole antenna 44 and each segment of the dipole antenna 42 may be a microstrip having a length equivalent to ¼ wavelength (e.g., ¼ (A)=c/f, $0.25*3\times10^8/60\times10^9=1.25$ mm). As another example, a ¼ wavelength antenna at 900 MHz has a total length of approximately 8.3 centimeters (i.e., $0.25*(3\times10^8$ m/s)/$(900\times10^6$ c/s)=0.25*33 cm, where m/s is meters per second and c/s is cycles per second). As a further example, a ¼ wavelength antenna at 2400 MHz has a total length of approximately 3.1 cm (i.e., $0.25*(3\times10^8$ m/s)/$(2.4\times10^9$ c/s)=0.25*12.5 cm). As yet one more example, a ¼ wavelength antenna at 5500 MHz has a total length of approximately 1.36 cm (i.e., $0.25*(3\times10^8$ m/s)/$(5.5\times10^9$ c/s)=0.25*5.45 cm). Note that the other performance requirements are affected by trace thickness, use of a ground plane, and/or other physical characteristics of the antennas.

Figure 5:
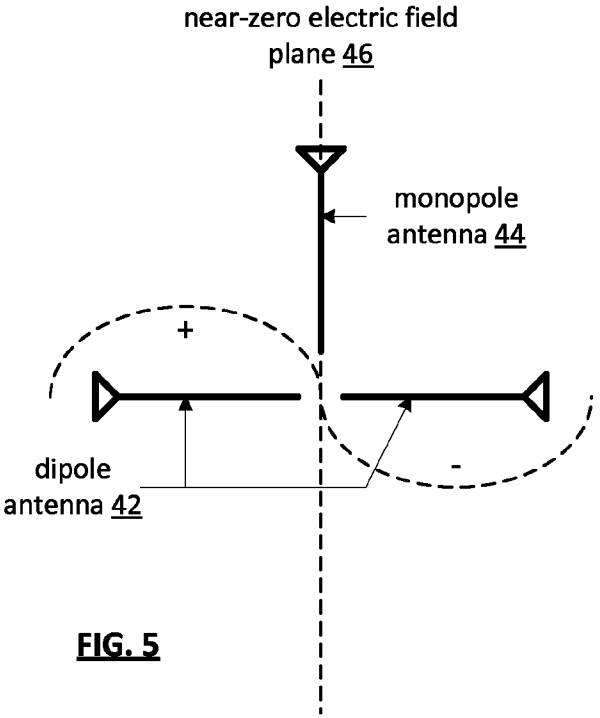
FIG. 5 is a schematic diagram of an embodiment of a multiple antenna apparatus in accordance with the present invention.

FIG. 5 is a schematic diagram of an embodiment of a multiple antenna apparatus that includes the dipole antenna 42 and the monopole antenna 46. In this diagram, the dipole antenna 42 generates a near-zero electric field plane 46 that is substantially perpendicular to the elements of the dipole antenna 42. As is further shown, the monopole antenna 44 is positioned in the near-zero electric field plane 46 to provide isolation from the dipole antenna 42.

Figure 6:
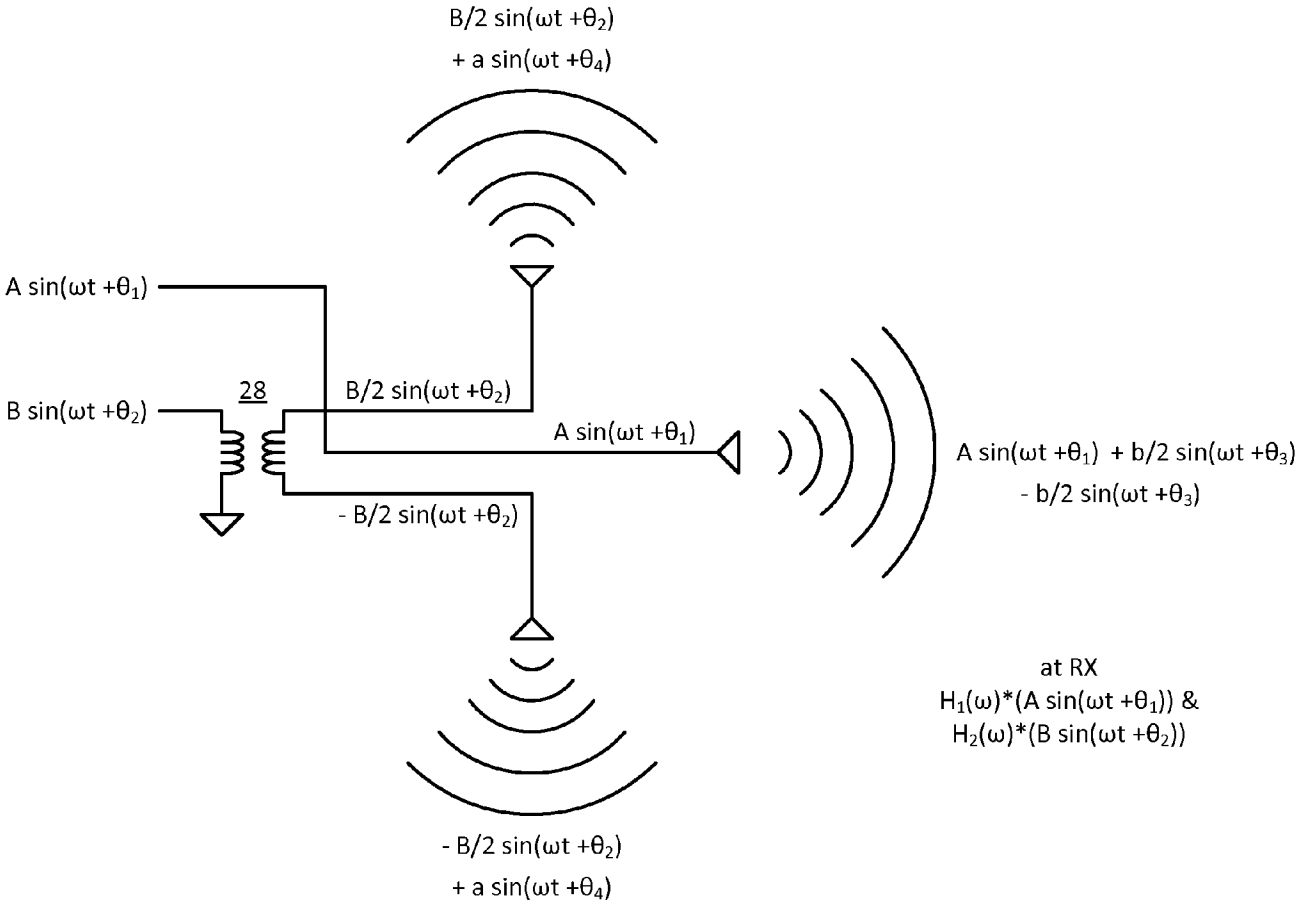
FIG. 6 is a schematic diagram of another embodiment of a multiple antenna apparatus in accordance with the present invention.

FIG. 6 is a schematic diagram of another embodiment of a multiple antenna apparatus that includes a dipole antenna and a monopole antenna. The monopole antenna receives a signal that may be represented as $A*\sin(\omega t+\theta_1)$ and the dipole antenna receives, via the transformer balun 28, an inverted and a non-inverted signal, which may be represented as $-B/2*\sin(\omega t+\theta_2)$ and $B/2*\sin(\omega t+\theta_2)$, respectively.

The non-inverting antenna element of the dipole antenna transmits the non-inverted signal $B/2*\sin(\omega t+\theta_2)$ and the inverting antenna element of the dipole antenna transmits the inverted signal $-B/2*\sin(\omega t+\theta_2)$. The radiation patterns from the inverting and non-inverting antenna elements produce a near-zero electric field plane. With the monopole antenna positioned in alignment with the near-zero electric field plane, the radiated signal from the non-inverting antenna (e.g., $b/2*\sin(\omega t+\theta_3)$) it receives is substantially cancelled by the radiated signal from the inverting antenna (e.g., $-b/2*\sin(\omega t+\theta_3)$). Thus, at the receiver end, the transmitted signal (e.g., $A*\sin(\omega t+\theta_1)+b/2*\sin(\omega t+\theta_3)-b/2*\sin(\omega t+\theta_3)$) is modified by the channel (e.g., $H_1(\omega)$) to produce the received signal of $H_1(\omega)*A*\sin(\omega t+\theta_1)$.

The signals transmitted by the dipole antenna elements may combine in air with a component on the transmitted signal of the monopole antenna (e.g., $a*\sin(\omega t+\theta_4)$. Thus, at the receiver end, the inverted and non-inverted transmitted signals (e.g., $-B/2*\sin(\omega t+\theta_2)+a*\sin(\omega t+\theta_4)$ and $B/2*\sin(\omega t+\theta_2)+a*\sin(\omega t+\theta_4)$ are modified by a second channel (e.g., $H_2(\omega)$ to produce a received inverted signal (e.g., $H_2(w)*(-B/2*\sin(\omega t+\theta_2)+a*\sin(\omega t+\theta_4))$) and a received non-inverted signal (e.g., $H_2(\omega)*(B/2*\sin(\omega t+\theta_2)+a*\sin(\omega t+\theta_4))$). Within the receiver, the received inverted signal is subtracted from the non-inverted signal yielding a received signal (e.g., $H_2(\omega)*(B*\sin(\omega t+\theta_2))$).

Figure 7:
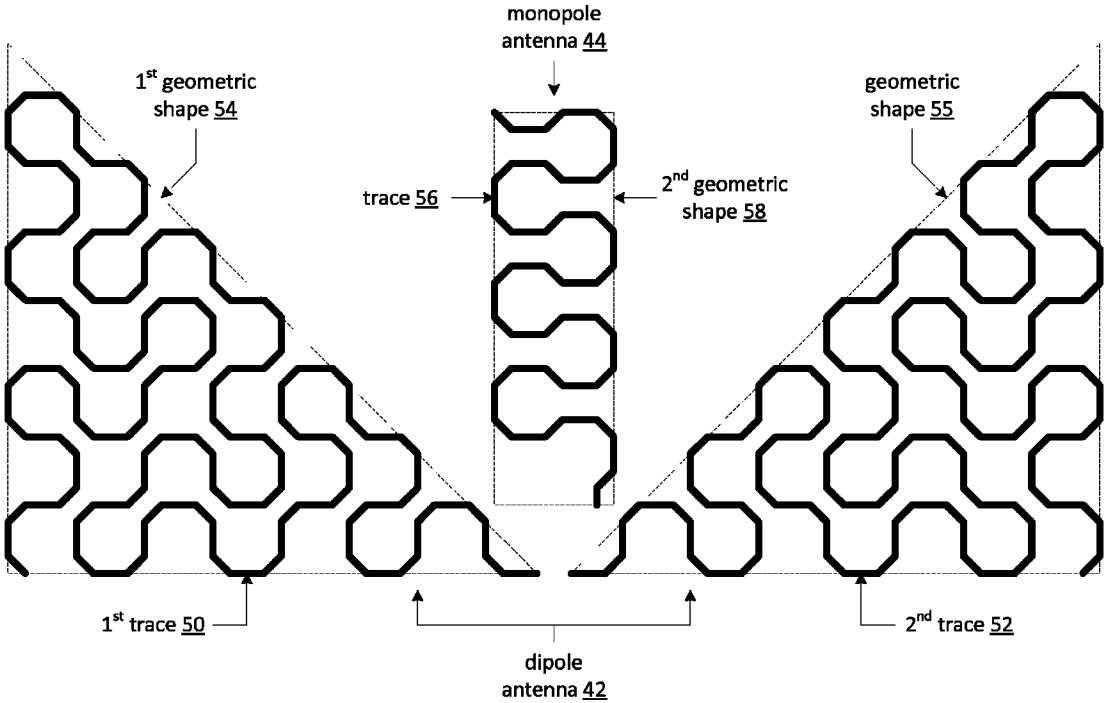
FIG. 7 is a block diagram of another embodiment of a multiple antenna apparatus in accordance with the present invention.

FIG. 7 is a block diagram of another embodiment of a multiple antenna apparatus that includes a monopole antenna 44 and a dipole antenna 42. In this embodiment, the dipole antenna 42 includes a first trace 50 confined within a first geometric shape 54 and a second trace 52 confined within a second geometric shape 55. Similarly, the monopole antenna 44 includes a trace 56 that is confined within a second geometric shape 58. The geometric shapes 54, 55, and 58 may be the same geometric shape (e.g., a triangle, a square, a rectangle, polygon, a parallelogram, rhombus, circle, oval, ellipse, etc.), they may each be of a different shape, or a combination thereof. Note that the shape may be a combination of geometric shapes as may be dictated by available layout space on a printed circuit board and/or integrated circuit die(s).

Each of the traces 50, 52, and 56 may have a recursive fractal curve pattern that includes one or more of the following properties: an $n^{th}$ order, where n is equal to or greater than 1; a $y^{th}$ order, where y is equal to or greater than 1; a first line width; a second line width; a first shaping factor; and a second shaping factor. The recursive fractal curve patterns may be one or more of a vonKoch curve, a Peano's curve, a modified Peano curve, a Cesaro triangle curve, a Modified Cesaro curve, a Dragon Curve, a Modified Dragon Curve, a Polya's Curve, a Modified Polya Curve (as shown in this figure), a Hilbert's curve, a tree of triangles curve, a Ternary Tree curve, a Quaternary tree curve, an H fractal tree curve, a Modified H fractal tree curve, a Tree of squares curve, a tree of almost squares curve, a Pythagorean tree curve, an alternating Pythagorean tree curve, and a Bronchial system tree curve. For example, each trace may be of the same recursive fractal curve pattern, different recursive fractal curve patterns, or a combination thereof.

FIGS. 8A-C are diagrams of another embodiment of a multiple antenna apparatus 22 that includes the substrate 40, the traces 50 and 52 of the dipole antenna 42, and the trace 56 of the monopole antenna 44. As shown, the substrate 40 includes a first layer 68 and a second layer 70. Note that the substrate 40 may include more than two layers.

The first trace 50 of the dipole antenna 42 includes a first segment 60 that is on the first layer 68 and a second segment 64 that is on the second layer 70. As shown, the geometric shapes of the first and second segments 60 and 64 are different, however, they could be the same. The first and second segments 60 and 64 are electrically coupled together to increase the length and/or width of the trace 50 of the dipole antenna. For example, when the available layout space on the first layer 68 (e.g., first geometric shape 54) is insufficient to accommodate the desired length and/or desired width of the trace 50, then available layout space on the second layer is used. Note that availably layout space on additional layers may be used to achieve the desired length and/or desired width if they cannot be achieved on two layers. Further note that the first segments 60 and 62 of the first and second traces 50 and 52 collectively have a bow tie shape, which increases the bandwidth of the dipole antenna 42.

The second trace 52 of the dipole antenna 42 includes a first segment 62 that is one the first layer 68 and a second segment 66 that is one the second layer 70. As shown, the geometric shapes of the first and second segments 62 and 66 are different, however, they could be the same. The first and second segments 62 and 66 are electrically coupled together to increase the length and/or width of the trace 52 of the dipole antenna.

Similarly, the trace 56 of the monopole antenna 44 includes a first segment 72 that is one the first layer 68 and a second segment 74 that is one the second layer 70. As shown, the geometric shapes of the first and second segments 72 and 74 are different, however, they could be the same. The first and second segments 72 and 74 are electrically coupled together to increase the length and/or width of the trace 56 of the monopole antenna.

FIGS. 9A-C are diagrams of another embodiment of a multiple antenna apparatus that includes the substrate 40, the dipole antenna 42, and the monopole antenna 44. In this embodiment, the dipole antenna 42 is on a first layer 68 of the substrate 40 and the monopole antenna 44 is on a second layer 70 of the substrate 40.

FIG. 10 is a diagram of another embodiment of a multiple antenna apparatus that includes the substrate 40, the dipole antenna 42, the monopole antenna 44, and a ground plane 75. In this illustration, the ground plane 75 is shown on the same layer of the substrate as the antennas 42 and 44. In another embodiment, the monopole antenna 44 may be printed on a first layer of the substrate 40, the dipole antenna 42 on a sixth layer of the substrate 40, and the ground plane 75 is printed on layers 2-5 of the substrate. In another embodiment, one or more transmission lines may be printed on one or more layers of the substrate to provide coupled to one or more of the antennas 42 and 44.

FIG. 11 is a diagram of another embodiment of a multiple antenna apparatus 22 that includes the substrate 40, a first antenna structure 80, and a second antenna structure 82. The first antenna structure 80 has a first fractal pattern metal trace 86 confined in a first geometric shape 88 and has a near-zero electric field plane 84. The second antenna structure 82 has a second fractal pattern metal trace 90 confined to a second geometric shape 92 and is positioned on the substrate 40 in substantial alignment with the near-zero electric field plane 84. In this manner, the second antenna structure 82 is isolated (e.g., >20 dB) from the first antenna structure 80. Further, each of the first and second antenna structures 80 and 82 having a length tuned to a first frequency band and/or a second frequency band. For example, the first antenna structure 80 may be tune for 2.4 GHz operation and the second antenna structure 82 may be tuned for 5.5 GHz operation.

In a further embodiment, each of the first and second fractal pattern metal traces 86 and 90 includes a geometric shape of a recursive fractal curve pattern, wherein the recursive fractal curve pattern includes at least one of: an $n^{th}$ order, where n is equal to or greater than 1; a $y^{th}$ order, where y is equal to or greater than 1; a first line width; a second line width; a first shaping factor; and a second shaping factor. For example, the first fractal pattern may be a $7^{th}$ order modified Polya curve having a first line width (e.g., trace width) and the second fractal pattern may be a $5^{th}$ order modified Polya curve of a second line width. Note that the first geometric shape 88 may substantially equal the second geometric shape 92 or they may be different. Further note that the sizes of the first and second geometric shapes may be the same or they may be different.

In another embodiment, the first fractal pattern metal trace 86 includes a first segment and a second segment. The first segment is on a first layer of the substrate and has a first segment geometric shape. The second segment is on a second layer of the substrate 40 and has a second segment geometric shape. Note that the first and second segments are coupled together to increase the desired length and/or width of the first fractal pattern metal trace 86. Similarly, the second fractal pattern metal trace 90 includes third and fourth segments. The third segment on the first layer of the substrate and has a third segment geometric shape; and the fourth segment is on the second layer of the substrate and has a fourth segment geometric shape. The fourth segment is coupled to the third segment. A similar embodiment was previously discussed with reference to FIG. 8.

FIG. 12 is a schematic diagram of another embodiment of a multiple antenna apparatus that includes a dipole antenna 42 and a monopole antenna 44. The monopole antenna 44 receives a signal via a first port (p1) and a capacitor-inductor filter network. The dipole antenna 42 receives (via the transformer balun 28, an inductor-capacitor filter network, and capacitors) an inverted and a non-inverted representation of a signal received via a second port (p2).

The non-inverting antenna element of the dipole antenna transmits the non-inverted signal and the inverting antenna element of the dipole antenna transmits the inverted signal. The radiation patterns from the inverting and non-inverting antenna elements produce a near-zero electric field plane. With the monopole antenna positioned in alignment with the near-zero electric field plane, the radiated signal from the non-inverting antenna it receives is substantially cancelled by the radiated signal from the inverting antenna.

In a specific example, the capacitor-inductor filter network coupled to the monopole antenna may include a first capacitor having a 5.3 pico-Farad (pF) capacitance, an inductor having a 0.5 nano-Henry (nH) inductance, and a second capacitor having a 7.6 pF capacitance. The inductor-capacitor filter network coupled to the dipole antenna includes a 0.8 pF capacitor and a 2.6 nH inductor. A 7.0 pF capacitor may be coupled to the non-inverting leg of the transformer 28 and a 7.5 pF capacitor may be coupled to the inverting leg of the transformer 28.

FIGS. 13A-C are diagrams of another embodiment of a multiple antenna apparatus 22 that includes the substrate 40, the dipole antenna 42, the monopole antenna 44, and a ground plane 75. As shown, the substrate 40 includes a first layer 68 and a second layer 70. Note that the substrate 40 may include more than two layers.

The dipole antenna 42 includes segments on the first layer 68 and segments on the second layer 70. The dipole segments are adjacent to the monopole antenna 44 and each dipole segment may include one or more dipole slabs of the same or varied geometric shapes.

The monopole antenna 44 includes a segment on the first layer 68 and a segment on the second layer 70. The segments may be of same or different geometric shape. As positioned, the monopole antenna 44 is in the near-zero electric field plane of the dipole antenna 42.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

What is claimed is:

1. A multiple antenna apparatus comprises:

a substrate;

a first antenna structure including a first metal trace that has a first pattern confined in a first geometric shape, where the first antenna structure has a near-zero electric field plane, and wherein the substrate supports the first antenna structure;

a second antenna structure including a second metal trace that has a first pattern confined to a second geometric shape, wherein the second antenna structure is positioned on the substrate in substantial alignment with the near-zero electric field plane of the first antenna structure; and the first metal trace including:

a first segment on a first layer of the substrate, wherein the first segment has a first segment geometric shape; and a second segment on a second layer of the substrate, wherein the second segment is coupled to the first segment, wherein the second segment has a second segment geometric shape, and wherein the first geometric shape includes the first and second segment geometric shapes; and the second metal trace including:

a third segment on the first layer of the substrate, wherein the third segment has a third segment geometric shape; and a fourth segment on the second layer of the substrate, wherein the fourth segment is coupled to the third segment, wherein the fourth segment has a fourth segment geometric shape, and wherein the second geometric shape includes the third and fourth segment geometric shapes.

2. The multiple antenna apparatus of claim 1, wherein each of the first patterns of the first and second metal traces comprises a geometric shape of a recursive fractal curve pattern, wherein the recursive fractal curve pattern includes at least one of:

an $n^{th}$ order, where n is equal to or greater than 1;

a $y^{th}$ order, where y is equal to or greater than 1;

a first line width;

a second line width;

a first shaping factor; and a second shaping factor.

3. The multiple antenna apparatus of claim 1 further comprises the first geometric shape substantially equals the second geometric shape, wherein the first geometric shape is of a first size and the second geometric shape is of a second size.

4. The multiple antenna apparatus of claim 1 further comprises at least one of:

the first antenna structure including a dipole antenna and the second antenna structure including a monopole antenna; and the first antenna structuring including multiple antennas and the second antenna structure including at least one antenna.

5. The multiple antenna apparatus of claim 4, wherein the dipole antenna further comprises a bow tie shape.

6. The multiple antenna apparatus of claim 4 further comprises:

the dipole antenna on a first layer of the substrate; and the monopole antenna on a second layer of the substrate.

7. The multiple antenna apparatus of claim 1 further comprises:

a ground plane electromagnetically coupled to at least one of the first and second antenna structures.

8. The multiple antenna apparatus of claim 1 further comprises each of the first and second antenna structures having a length tuned to at least one of a first frequency band and a second frequency band.

9. A multiple antenna apparatus comprises:

a substrate;

a dipole antenna that has a near-zero electric field plane, wherein the substrate supports the dipole antenna; and a monopole antenna positioned on the substrate in substantial alignment with the near-zero electric field plane of the dipole antenna; and a first and second trace of the dipole antenna including:

a first segment on a first layer of the substrate, wherein the first segment has a first segment geometric shape; and a second segment on a second layer of the substrate, wherein the second segment is coupled to the first segment, wherein the second segment has a second segment geometric shape, and wherein the first geometric shape includes the first and second segment geometric shapes; and a trace of the monopole antenna including:

a third segment on the first layer of the substrate, wherein the third segment has a third segment geometric shape; and a fourth segment on the second layer of the substrate, wherein the fourth segment is coupled to the third segment, wherein the fourth segment has a fourth segment geometric shape, and wherein the second geometric shape includes the third and fourth segment geometric shapes.

10. The multiple antenna apparatus of claim 9 further comprises:

the first trace of the dipole antenna having the first geometric shape;

the second trace of the dipole antenna having the first geometric shape;

the trace of the monopole antenna having the second geometric shape, wherein each of the first and second geometric shapes includes a recursive fractal curve pattern, wherein the recursive fractal curve pattern includes at least one of:

an $n^{th}$ order, where n is equal to or greater than 1;

a $y^{th}$ order, where y is equal to or greater than 1;

a first line width;

a second line width;

a first shaping factor; and a second shaping factor.

11. The multiple antenna apparatus of claim 9, wherein the dipole antenna further comprises a bow tie shape.

12. The multiple antenna apparatus of claim 9 further comprises:

the dipole antenna on a first layer of the substrate; and the monopole antenna on a second layer of the substrate.

13. The multiple antenna apparatus of claim 9 further comprises:

a ground plane electromagnetically coupled to at least one of the dipole antenna and the monopole antenna.

14. A wireless front-end comprises:

a first amplifier;

a second amplifier;

a transformer balun operably coupled to the first amplifier; and a multiple antenna apparatus that includes:

a substrate;

a dipole antenna operably coupled to the transformer balun, wherein the dipole antenna has a near-zero electric field plane, and wherein the substrate supports the dipole antenna; and a monopole antenna operably coupled to the second amplifier, wherein the monopole antenna is positioned on the substrate in substantial alignment with the near-zero electric field plane of the dipole antenna; and the dipole antenna comprising at least a first and second trace including:

a first segment on a first layer of the substrate, wherein the first segment has a first segment geometric shape; and a second segment on a second layer of the substrate, wherein the second segment is coupled to the first segment, wherein the second segment has a second segment geometric shape, and wherein the first geometric shape includes the first and second segment geometric shapes; and the monopole antenna comprising at least a first trace including:

a third segment on the first layer of the substrate, wherein the third segment has a third segment geometric shape; and a fourth segment on the second layer of the substrate, wherein the fourth segment is coupled to the third segment, wherein the fourth segment has a fourth segment geometric shape, and wherein the second geometric shape includes the third and fourth segment geometric shapes.

15. The wireless front-end of claim 14, wherein the multiple antenna apparatus further comprises:

the first trace of the dipole antenna having the first geometric shape;

the second trace of the dipole antenna having the first geometric shape;

the trace of the monopole antenna having the second geometric shape, wherein each of the first and second geometric shapes includes a recursive fractal curve pattern, wherein the recursive fractal curve pattern includes at least one of:

an $n^{th}$ order, where n is equal to or greater than 1;

a $y^{th}$ order, where y is equal to or greater than 1;

a first line width;

a second line width;

a first shaping factor; and a second shaping factor.

16. The wireless front-end of claim 14, wherein the dipole antenna further comprises a bow tie shape.

17. The wireless front-end of claim 14 further comprises:

the dipole antenna on a first layer of the substrate; and the monopole antenna on a second layer of the substrate.

18. The wireless front-end of claim 14, wherein the multiple antenna apparatus further comprises:

a ground plane electromagnetically coupled to at least one of the dipole antenna and the monopole antenna.

19. The wireless front-end of claim 14 further comprises:

the first amplifier including a power amplifier of a transmitter; and the second amplifying including a low noise amplifier of a receiver.

20. The wireless front-end of claim 14 further comprises:

the first amplifier amplifying a first transmission signal of a multiple input multiple output (MIMO) signal or a single input multiple output (SIMO) signal; and the second amplifier amplifying a second transmission signal of the MIMO or SIMO signal.

21. The wireless front-end of claim 14 further comprises:

the first amplifier amplifying a first reception signal of a multiple input multiple output (MIMO) signal or multiple input single output (MISO) signal; and the second amplifier amplifying a second reception signal of the MIMO of MISO signal.

* * * * *

UNITED STATES PATENT AND TRADEMARK OFFICE

CERTIFICATE OF CORRECTION

PATENT NO. : 8,570,229 B2
APPLICATION NO. : 12/772129
DATED : October 29, 2013
INVENTOR(S) : Seunghwan Yoon et al.

It is certified that error appears in the above-identified patent and that said Letters Patent is hereby corrected as shown below:

In the Claims

Col. 16, line 26, in claim 21: replace "MIMO of MISO signal" with --MIMO or MISO signal--

Signed and Sealed this
Twenty-sixth Day of August, 2014

Michelle K. Lee

Michelle K. Lee
*Deputy Director of the United States Patent and Trademark Office*